US006084219A

United States Patent [19]

Winter

[11] Patent Number: 6,084,219

[45] **Date of Patent: *Jul. 4, 2000**

[54] RESISTANCE HEATING DEVICE

[76] Inventor: Josef Winter, Im Gabis 2a, 85296 Rohrbach, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/948,421

[22] Filed: Oct. 10, 1997

[30] Foreign Application Priority Data

Feb. 5, 1997 [DE] Germany ..... 197 04 352

[51] Int. Cl.[7] ..... H05B 1/00; H05B 3/02

[52] U.S. Cl. ..... 219/539; 219/219

[58] Field of Search ..... 219/539, 541, 219/543, 552, 203, 219; 338/306, 307, 308, 309, 22 R

[56] References Cited

U.S. PATENT DOCUMENTS

| | | | |
|---|---|---|---|
| 3,351,882 | 11/1967 | Kohler et al. . | |
| 4,368,380 | 1/1983 | Igashira et al. | 219/539 |
| 4,453,669 | 6/1984 | Karla et al. | 237/12.3 |
| 4,743,741 | 5/1988 | Ramus | 219/543 |
| 4,744,844 | 5/1988 | Hurst . | |
| 4,931,627 | 6/1990 | Watts | 219/548 |
| 4,933,533 | 6/1990 | Simpson | 219/219 |
| 5,132,840 | 7/1992 | Okada et al. | 359/512 |
| 5,146,536 | 9/1992 | Westover | 392/488 |
| 5,214,738 | 5/1993 | Nakajima et al. | 338/22 R |
| 5,354,966 | 10/1994 | Sperbeck | 219/203 |
| 5,418,025 | 5/1995 | Harmand et al. | 428/38 |
| 5,471,034 | 11/1995 | Kawate et al. | 219/485 |
| 5,653,903 | 8/1997 | Pinchok et al. | 219/203 |

FOREIGN PATENT DOCUMENTS

| | | |
|---|---|---|
| 0 172 302 B1 | 2/1986 | European Pat. Off. . |
| 0 356 087 A2 | 2/1990 | European Pat. Off. . |

*Primary Examiner*—Philip H. Leung
*Assistant Examiner*—Daniel Robinson
*Attorney, Agent, or Firm*—Oblon, Spivak, McClelland, Maier & Neustadt, P.C.

[57] ABSTRACT

A flat resistance heating device with a heating layer including of a material having a positive resistance/temperature coefficient to which current or voltage can be applied via electrodes. In order to reduce the current uptake in the switch-on phase and hence to reduce the risk of a burn-through effect, the individual heating elements of the resistance heating device have a meniscus shape, so that they heat more rapidly in the narrow region when switched on and hence reduce the current uptake.

36 Claims, 2 Drawing Sheets

RESISTANCE HEATING DEVICE

DESCRIPTION

1. Field of the Invention

The present invention is related to a flat resistance heating device. More particularly, the present invention is related to a resistance heating device having individual (Positive Temperature Coefficient) PTC elements as heating elements.

2. Discussion of the Background

The EP No. 0 172 302 B1 discloses a flat resistance heating device with a plurality of parallel electrodes arranged on a flat, electrically insulating substrate. The electrodes are alternatingly connected to one of two electric main feed lines. In addition, a flat layer of PTC material is applied over the electrode pattern which forms heating "zones" between the adjacent electrodes. The PTC material is also covered by an adhesive layer, which allows the device to be attached to a flat object, such as a mirror. A disadvantage of this heating device is that a large amount of PTC material is needed to cover the device, thus the cost of the device is increased.

The EP No. 0 356 087 B1 discloses a flat PTC heating device similar to the device discussed above, except the PTC layer is not applied over the entire electrode pattern. Rather, the PTC material is applied in individual strips which are parallel and transverse to the electrodes, thus reducing the amount PTC material needed.

However, disadvantages with both of these PTC heating devices is that when the device is switched on (switch-on phase), a high uptake of power takes places as a result of comparatively long-lasting current peaks. This is because the entire PTC layer must first heat up before the current uptake is reduced due to a positive temperature coefficient of resistance, hereinafter refered to as positive resistance/temperature coefficient, of the PTC layer. The main electric feed lines are normally produced from silver paste and have to be designed to handle these high current peaks during the switch-on phase. Thus, the main electric feed lines have a wide width which increases the amount of silver paste required, and therefore the cost of the PTC heating device is also increased. In addition, the proportion of an area of an object in which there are no PTC heating elements present is increased. That is, heating in this area only takes place as a result of the main feed lines electrical resistance.

Further, the main feed lines made with silver paste are very susceptible to a "burn-through" effect in a corner region having sharp edges. In order to prevent the burn-through effect, the main feed lines were increased in width but this resulted in more silver paste being required.

SUMMARY OF THE INVENTION

Accordingly, one object of the present invention is to provide a resistance heating device such that when the power is switched on a reduced current and power uptake is possible.

Another object of the present invention is to provide a resistance heating device with individual PTC elements which have a meniscus shape. That is, a width of the PTC element tapers continuously from a contact point with a first electrode in a direction toward a center between a first and a second electrode, and subsequently broadens continuously toward a contact point with the second electrode. In other words, an upper and lower boundary line of the PTC element have a circular arc shape with the two boundary lines facing each other with opposite curvature. Alternatively, the boundary lines may also have a parabolic shape. An optimum shape of the meniscus-like PTC elements, and in particular a length and a thinnest region between the electrodes is related to a minimum current and power uptake during the switch-on phase.

Yet another object of the present invention is to provide a resistance heating device with individual PTC elements which are arranged to create a constant heating capacity per unit area.

Still another object of the present invention is to provide a resistance heating device with main feed lines that have rounded edges, which results in a further reduction of the width of the main feed lines and a reduction in peak effects and associated high electrical fields. Thus, a burn-through effect is prevented.

These and other objects are accomplished by providing a resistance heating device with individual PTC heating elements which are thinner in a region between respective electrodes than in a region where the PTC elements contact an electrode (contact region). During the switch-on phase, the small-area or point-like regions between the electrode heat up quickly, thus the current uptake is quickly reduced because of a positive resistance/temperature coefficient of the individual PTC elements. Therefore, with a reduced current uptake during the switch-on phase, the main feed lines (made for example of silver paste) can be thinner, and hence more cost-effective.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
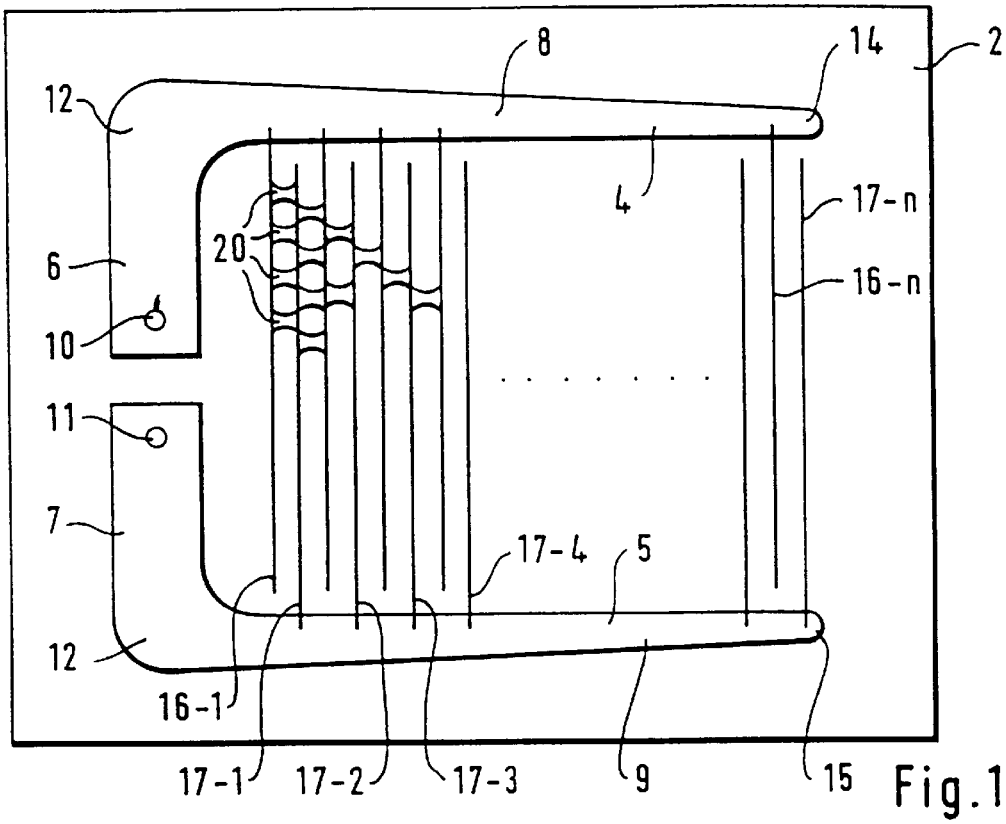
FIG. 1 shows a schematic representation of a resistance heating device according to the present invention.

Referring now to the drawings, wherein like reference numerals designate identical or corresponding parts throughout the several views and more particularly to FIG. 1 thereof, there is illustrated two main feed lines 4 and 5 on a substrate 2 in a form of L-shaped conductor tracks. The main feed line 4 has a first limb 6 and a second limb 8. In addition, the main feed line 5 has a first limb 7 and second limb 9.

The two first limbs 6 and 7 of the respective main feed lines 4 and 5 extend vertically in opposite directions from a central left-hand edge region of a substrate 2 starting from a pair of electrical connections 10 and 11. As shown in FIG. 1, the two first limbs 6 and 7 merge into the associated second limbs 8 and 9 in a region of a bend 12. The two second limbs 8 and 9 extend at a respective upper and lower edge of the substrate 2 toward free ends 14 and 15, respectively, at a right-hand edge of the substrate 2. In addition, since the free ends 14 and 15 provide current feed for fewer electrodes 16-n and 17-n than regions closer to the bend 12, the limbs 8 and 9 are designed to taper toward the free ends 14 and 15. Further, a multiplicity of electrodes 16-n and 17-n extend between the two second limbs 8 and 9 of the main feed lines 4 and 5 (arranged on the substrate 2 to form a U-shape). The first electrodes 16-n are in each case connected to the first main feed line 4 and the second electrodes 17-n are connected to the second main feed line 5. In addition, a multiplicity of meniscus-shaped PTC elements 20 are arranged between two directly adjacent electrodes 16-n and 17-n, thus creating heating zones between adjacent electrodes.

Figure 2:
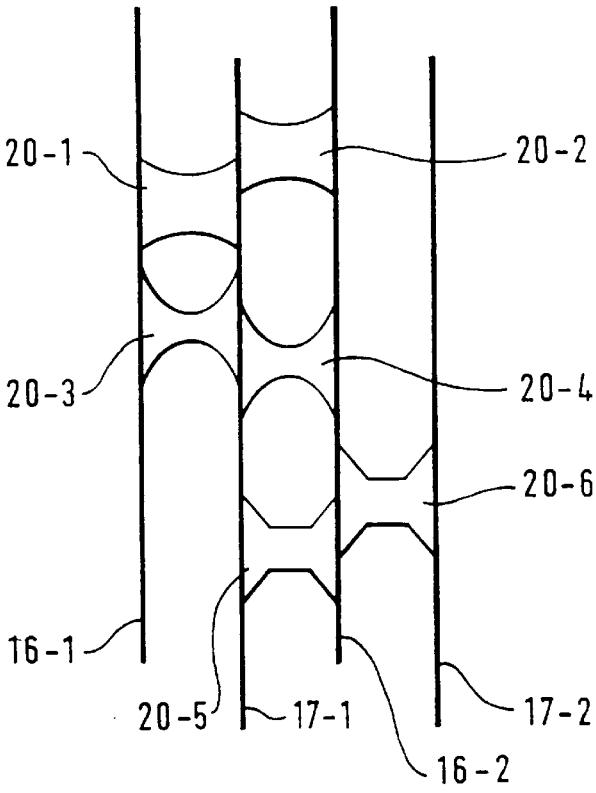
FIG. 2 is a detailed drawing showing different shapes of individual PTC elements according to the present invention.

FIG. 2 is an enlarged view illustrating a partial region of parallel electrodes 16-n and 17-n with PTC elements located between them. The different shapes shown for the PTC elements (i.e., 20-1, 20-2, etc.) are illustrated by way of example only. The PTC elements 20-1 and 20-2 have circular arc-shaped boundary lines between the associated electrodes 16-1, 17-1, 16-2, and 17-2; in the case of PTC elements 20-3 and 20-4 the boundary lines are paraboloid; and in the case of PTC elements 20-5 and 20-6 the boundary lines are trapezoidal, that is they have a region of constant thickness in the center between the associated electrodes.

When the heating device is switched on (by applying an electrical voltage to the connections 10 and 11), a comparatively high current flows for a short time through the device. As a result of this high current, the thin regions of the PTC elements 20 between the electrodes 16-n and 17-n are heated instantaneously which creates an increase in a resistance of the PTC elements 20-n, and therefore a current uptake decreases. In other words, the relatively thin sections of the PTC elements 20 heat up quickly, which results in an increase in resistance in this region and the entire PTC element (because of a positive resistance/temperature coefficient). Therefore, the maximum current uptake level and a time for which this occurs is reduced during the switch-on phase.

From experiments performed by the present inventor, it was determined that a burn-through effect in the main feed lines 4 and 5 occurs when the bend region 12 has sharp edges or corners. This is probably due to peak effects of electric fields at these corners. Accordingly, a resistance heating device according to the present invention is designed so that a maximum applied current intensity does not cause this burn-through effect in the main feed lines 4 and 5. In order to accomplish this, the main feed lines 4 and 5, and in particular their associated first limbs 6 and 7 are designed to be adequately wide. In addition, the main feed lines 4 and 5 boundary lines are rounded off in the region of the bend 12, which prevents the burn-through effect. In addition, the thinner main feed line reduces the amount of material needed and reduces areas which are not desired to be heated.

Figure 3:
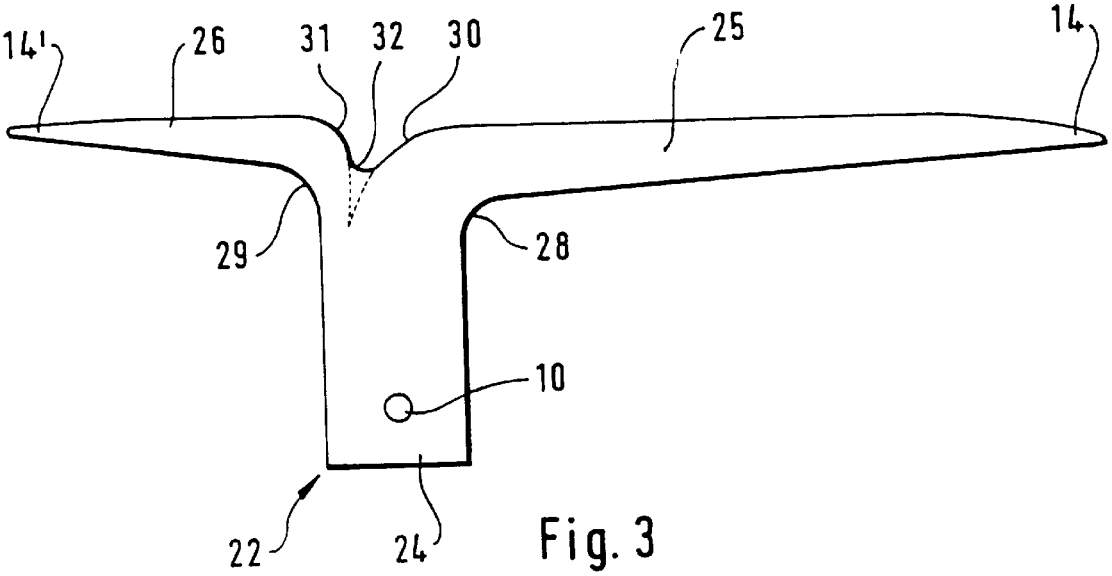
FIG. 3 shows a detailed representation of a T-shaped main feed line according to the present invention.

FIG. 3 illustrates another embodiment of the present invention. As shown, a T-shaped main feed line 22 has a first limb 24, a second limb 25, and a third limb 26. In addition, inner bends 28 and 29 (at an upper end of the first limb 24) are rounded and the opposite boundary lines of the associated second and third limbs 25 and 26 are also rounded (i.e., regions 30 and 31). This reduces the amount of material needed to construct the device compared to that if a rectangular shape was used. Further, an acute-angled meeting of the roundings 30 and 31, shown as dotted lines, is avoided by having the region 30 merge in an S-shape into the other region 31 (shown as region 32). The sharp corners in a lower region of the first limb 24, near the electrical connection 10, are not critical since current does not flow in this region.

With respect to the remaining construction of the heating device, and in particular the materials used, dimensions, protective films etc., reference is made to the known heating devices in accordance with EP-0 172 302 B1 and EP-0 356 087 B1, which are hereby incorporated as references.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A resistance heating device, comprising:

a substrate;

at least a first and second electrode arranged on a surface of said substrate;

a heating layer comprising a plurality of PTC elements which extend between said at least said first and second electrode, wherein at least one of said plurality of PTC elements comprises a width which tapers continuously from a contact area with said first electrode to a center point between said first and second electrode, and subsequently broadens continuously to a contact area with said second electrode.

2. A device according to claim 1, further comprising:

an adhesive layer arranged on said heating layer.

3. A device according to claim 1, wherein said substrate comprises an electrically insulating substrate.

4. A device according to claim 1, wherein said at least one of said plurality of PTC elements comprises a meniscus shape.

5. A device according to claim 4, wherein said plurality of PTC elements are substantially parallel to each other and comprise a constant heating capacity per unit area of said heating layer.

6. A device according to claim 4, further comprising:

at least two main feed lines each having an L-shape connecting said at least said first and second electrode, wherein a corner region of said L-shape is round.

7. A device according to claim 1, wherein said at least one of said plurality of PTC elements comprises a trapezoidal shape.

8. A device according to claim 1, wherein said plurality of PTC elements are substantially parallel to each other.

9. A device according to claim 5, wherein said plurality of PTC elements are substantially parallel to each other and comprise a constant heating capacity per unit area.

10. A device according to claim 1, further comprising:

at least two main feed lines each having an L-shape connecting said at least said first and second electrode.

11. A device according to claim 10, wherein a corner region of said L-shape is round.

12. A device according to claim 1, further comprising:

at least two main feed lines each having a T-shape having a first limb, a second limb, and a third limb, wherein said first limb and said second limb comprise tapered ends, and wherein an intersection of said first limb, said second limb, and said third limb comprises a round shape.

13. A method of making a resistance heating device including a substrate, comprising the steps of:

arranging at least a first and second electrode on a surface of said substrate; and applying a plurality of PTC elements which extend between said at least said first and second electrode, wherein at least one of said plurality of PTC elements comprises a width which tapers continuously from a contact area with said first electrode to a center point between said first and second electrode, and subsequently broadens continuously to a contact area with said second electrode.

14. A method according to claim 13, further comprising the step of:

applying an adhesive layer on said plurality of PTC elements.

15. A method according to claim 13, wherein said substrate comprises an electrically insulating substrate.

16. A method according to claim 13, further comprising the step of:

forming said at least one of said plurality of PTC elements to have a meniscus shape.

17. A method according to claim 16, further comprising the step of:

arranging said plurality of PTC elements substantially parallel to each other and to have a constant heating capacity per unit area.

18. A method according to claim 16, further comprising the step of:

connecting at least two main feed lines each having an L-shape to said at least said first and second electrode, wherein a corner region of said L-shape is round.

19. A method according to claim 13, further comprising the step of:

forming said at least one of said plurality of PTC elements to have a trapezodial shape.

20. A method according to claim 13, further comprising the step of:

arranging said plurality of PTC elements substantially parallel to each other.

21. A method according to claim 20, wherein said step of arranging arranges said plurality of PTC elements to have a constant heating capacity per unit area of said heating layer.

22. A method according to claim 13, further comprising the step of:

connecting at least two main feed lines each having an L-shape to said at least said first and second electrode.

23. A method according to claim 22, wherein a corner region of said L-shape is round.

24. A method according to claim 13, further comprising the step of:

connecting at least two main feed lines each having a T-shape having a first limb, a second limb, and a third limb, wherein said first limb and said second limb comprise tapered ends, and wherein an intersection of said first limb, said second limb, and said third limb comprises a round shape.

25. A system for heating an object with a resistance heating device including a substrate, comprising:

means for arranging at least a first and second electrode on a surface of said substrate; and means for applying a plurality of PTC elements which extend between said at least said first and second electrode, wherein at least one of said plurality of PTC elements comprises a width which tapers continuously from a contact area with said first electrode to a center point between said first and second electrode, and subsequently broadens continuously to a contact area with said second electrode.

26. A system according to claim 25, further comprising:

means for applying an adhesive layer on said plurality of PTC elements.

27. A system according to claim 25, wherein said substrate comprises an electrically insulating substrate.

28. A system according to claim 25, further comprising:

means for forming said at least one of said plurality of PTC elements to have a meniscus shape.

29. A system according to claim 28, further comprising:

means for arranging said plurality of PTC elements substantially parallel to each other and to have a constant heating capacity per unit area of said heating layer.

30. A system according to claim 25, further comprising:

means for forming said at least one of said plurality of PTC elements to have a trapezodial shape.

31. A system according to claim 25, further comprising:

means for arranging said plurality of PTC elements substantially parallel to each other.

32. A system according to claim 31, wherein said means for arranging arranges said plurality of PTC elements to have a constant heating capacity per unit area of said heating layer.

33. A system according to claim 25, further comprising:

means for connecting at least two main feed lines each having an L-shape to said at least said first and second electrode.

34. A system according to claim 33, wherein a corner region of said L-shape is round.

35. A system according to claim 25, further comprising:

means for connecting at least two main feed lines each having an L-shape to said at least said first and second electrode, wherein a corner region of said L-shape is round.

36. A system according to claim 25, further comprising:

means for connecting at least two main feed lines each having a T-shape having a first limb, a second limb, and a third limb, wherein said first limb and said second limb comprise tapered ends, and wherein an intersection of said first limb, said second limb, and said third limb comprises a round shape.

* * * * *